US007492089B2

(12) United States Patent
Cho et al.

(10) Patent No.: US 7,492,089 B2
(45) Date of Patent: Feb. 17, 2009

(54) ELECTRON EMISSION TYPE BACKLIGHT UNIT AND FLAT PANEL DISPLAY DEVICE HAVING THE SAME

(75) Inventors: Young-Suk Cho, Suwon-si (KR); Jae-Woo Bae, Suwon-si (KR); Dong-Hyun Kang, Suwon-si (KR); Ui-Song Do, Suwon-si (KR); Kyu-Nam Joo, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 314 days.

(21) Appl. No.: 11/493,510

(22) Filed: Jul. 27, 2006

(65) Prior Publication Data

US 2007/0024545 A1 Feb. 1, 2007

(30) Foreign Application Priority Data

Jul. 27, 2005 (KR) ..... 10-2005-0068531

(51) Int. Cl.
*H01J 1/62* (2006.01)

(52) U.S. Cl. ..... 313/497; 313/495; 313/294; 313/346 R

(58) Field of Classification Search ..... 313/495–497, 313/294, 296, 301, 304, 346 R, 351; 445/24
See application file for complete search history.

(56) References Cited

U.S. PATENT DOCUMENTS 6,445,125 B1 * 9/2002 Na et al. ..... 313/497
6,765,346 B2 * 7/2004 Lee et al. ..... 313/497
7,161,289 B2 * 1/2007 Lee et al. ..... 313/497
2004/0104668 A1 * 6/2004 Lee et al. ..... 313/496
2005/0116612 A1 * 6/2005 Oh ..... 313/497
2005/0197032 A1 * 9/2005 Lee et al. ..... 445/24
2007/0052338 A1 * 3/2007 Du et al. ..... 313/310

FOREIGN PATENT DOCUMENTS

JP 2003016905 1/2003
KR 1020030081866 10/2003
KR 1020040044101 5/2004

* cited by examiner

*Primary Examiner*—Peter Macchiarolo
(74) *Attorney, Agent, or Firm*—Lee & Morse, P.C.

(57) ABSTRACT

An electron emission type backlight unit which may include a front substrate and a rear substrate, a gate electrode, an insulating unit disposed on the gate electrode, a cathode disposed on the insulating unit that intersects the gate electrode, a first opening formed in the cathode to expose the gate electrode, a second opening formed in the insulating unit to expose the gate electrode, in which the second opening connects to the first opening, an electron emitting unit disposed on the cathode that exposes the gate electrode, in which the electron emitting unit is formed to trace along a boundary of the cathode that defines the first opening, an auxiliary gate electrode disposed on the gate electrode, in which the auxiliary gate electrode passes through the first opening and the second opening; and an anode and a light emitting unit.

21 Claims, 8 Drawing Sheets

ELECTRON EMISSION TYPE BACKLIGHT UNIT AND FLAT PANEL DISPLAY DEVICE HAVING THE SAME

BACKGROUND OF THE INVENTION

1. Field of the Invention

The present invention relates to an electron emission unit and a flat panel display device employing the electron emission unit. More particularly, the present invention relates to an electron emission unit that may prevent an anode electric field from penetrating a gate electric field so as to avoid arcing, and also may prevent a hazardous voltage being applied to an electron emitting unit and other elements. The present invention also relates to a flat panel display device employing the electron emission unit as a backlight unit.

2. Description of the Related Art

In general, flat panel display devices may be classified into emissive display devices and non-emissive display devices. Examples of the emissive display devices may include a cathode ray tubes (CRT), a plasma display panel (PDP) that may emit light using plasma generated by applying a strong voltage, a field emission display (FED) that may emit light by exciting a phosphor screen with electrons emitted from a plane cathode, a vacuum fluorescent display (VFD) that may emit light by creating thermal electrons through a voltage supplied in a filament and accelerating the electrons by means of a grid so that the electrons may reach an anode to collide with phosphors already patterned and illuminate for displaying information, and an organic light emitting device (OLED) that may emit light by running current through a fluorescent or phosphorescent organic thin film to make electrons and holes meet in the organic layer. An example of the non-emissive display device may include a liquid crystal display (LCD) that may use a liquid crystal that is in a state between solid and liquid and may act as a shutter to selectively transmit or block light according to voltage.

Among these examples, the LCD may be of light weight and low power consumption. However, the LCD may not display an image that is observable in a dark place because it is a light receiving display device and thus the image is produced not by self-emitting but by external light. Accordingly, the LCD may include a backlight unit at a rear side of the LCD apparatus to emit light. In this case, the LCD may also display an image that is observable even in a dark place.

While there may be different backlight units, a linear light source and a point light source may be used as an edge type backlight unit. Particularly, a cold cathode fluorescent lamp (CCFL) having electrodes at both ends of a tube may be commonly used as a linear light source. A light emitting diode (LED) may be commonly used as a point light source.

The CCFL may offer strong white light generation, superior brightness and uniformity, and easy large-scale design. However, the CCFL may operate using a high frequency alternating current. Additionally, the CCFL may operate within a narrow temperature range for light output to occur.

The LED may operate with less brightness and uniformity than the CCFL. This may be especially true in a larger size LED. Also, high power may be consumed when reflecting and transmitting light due to the light source being located on a rear side. Further, the structural complexities of a LED may result in higher production costs. However, the LED may operate using direct current instead of a high frequency alternating current. Additionally, the LED may offer improved power and temperature characteristics, smaller size and longer life expectancy.

Recently, electron emission units employed as backlight units using a planar light emitting structure have been proposed to solve the above-mentioned problems. These electron emission type backlight units may exhibit low power consumption and relatively uniform brightness, even over wider regions, as compared to a CCFL and the like.

For example, an electron emission unit employed as a backlight unit may have an upper substrate and a lower substrate that may be separated from each other by a predetermined gap. A fluorescent layer and an anode may be sequentially disposed on a bottom surface of the upper substrate, and a cathode may be disposed on a top surface of the lower substrate. Also, a stripe-patterned electron emitting unit may be disposed on the cathode.

An exemplary operation of the electron emission unit may include a predetermined voltage applied between the anode and the cathode. Electrons may be emitted from the electron emitting unit disposed on the cathode. The electrons emitted from the electron emitting unit may collide with the fluorescent layer and may excite fluorescent materials in the fluorescent layer, such that visible light may be emitted with extra energy.

However, since the cathode may be formed over the entire surface of the lower substrate, a high voltage directly applied between the anode and the cathode may cause local arcing. Due to the local arcing, the electron emission employed as a backlight unit may not ensure uniform brightness over the entire display surface. Furthermore, the local arcing may damage the anode and cathodes, the fluorescent layer, and the electron emitting layers, thereby shortening the life of the electron emission unit employed as a backlight unit.

SUMMARY OF THE INVENTION

The present invention is therefore directed to an electron emission unit and a flat panel display device employing the electron emission unit, which substantially overcome one or more of the problems due to the limitations and disadvantages of the related art.

It is therefore a feature of an embodiment of the present invention to provide an electron emission unit that may enhance brightness and uniformity by improving structures of a cathode, a gate electrode, and an electron emitting unit and also may extend the life of the electron emission unit by preventing inside deterioration, and a flat panel display device employing the electron emission unit as a backlight unit.

At least one of the above and other features and advantages of the present invention may be realized by providing an electron emission type backlight unit that may include a front substrate and a rear substrate, a gate electrode, an insulating unit disposed on the gate electrode, a cathode disposed on the insulating unit that intersects the gate electrode, a first opening formed in the cathode that exposes the gate electrode, a second opening formed in the insulating unit that exposes the gate electrode, in which the second opening connects to the first opening, an electron emitting disposed on the cathode that exposes the gate electrode, in which the electron emitting unit is formed to trace along a boundary of the cathode that defines the first opening, an auxiliary gate electrode disposed on the gate electrode, in which the auxiliary gate electrode passes through the first opening and the second opening, an anode, and a light emitting unit.

The cathode and the gate electrode may intersect each other at right angles.

The gate electrode may be patterned in two or more stripes. The ends of the stripes of the gate electrode may be electrically connected to each other. The gate electrode may be on a top surface of the rear substrate and a bottom surface of the gate electrode may not be larger than the top surface of the rear substrate.

The insulating unit may be larger than an area where the gate electrode and the cathode intersect each other.

The auxiliary gate electrode may have the same shape as the first or second openings and may have a diameter smaller than the diameters of each of the first and second openings. The auxiliary gate electrode may be taller than the electron emitting unit.

The cathode may be patterned in two or more stripes. The ends of the stripes of the cathode may have curved shapes. The cathode may be on a top surface of the rear substrate and a bottom surface of the cathode is not larger than the top surface of the rear substrate.

The first opening may be defined as a closed shape, the closed shape may include a circle shape, an oval shape, a square shape, or a star shape. The second opening may be defined as a closed shape, the closed shape may include a circle shape, an oval shape, a square shape, or a star shape.

The first opening may be larger than the second opening. The first opening and the second opening may be concentric. The first opening and the second opening may be substantially the same diameter and may be substantially concentric.

The first opening and the second opening may have substantially the same shape. The first opening may have a different shape than the second opening.

The electron emitting unit may be formed to protrude and cover the boundary of the cathode that may define the first opening, in which the protrusion may not exceed the boundary of the insulating unit that may define the second opening.

At least one of the above and other features and advantages of the present invention may be realized by providing a flat panel display device that may include the electron emission type backlight unit, and a display panel that may include a light receiving element that controls light received from the electron emission type backlight unit.

The light receiving element may be a liquid crystal.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
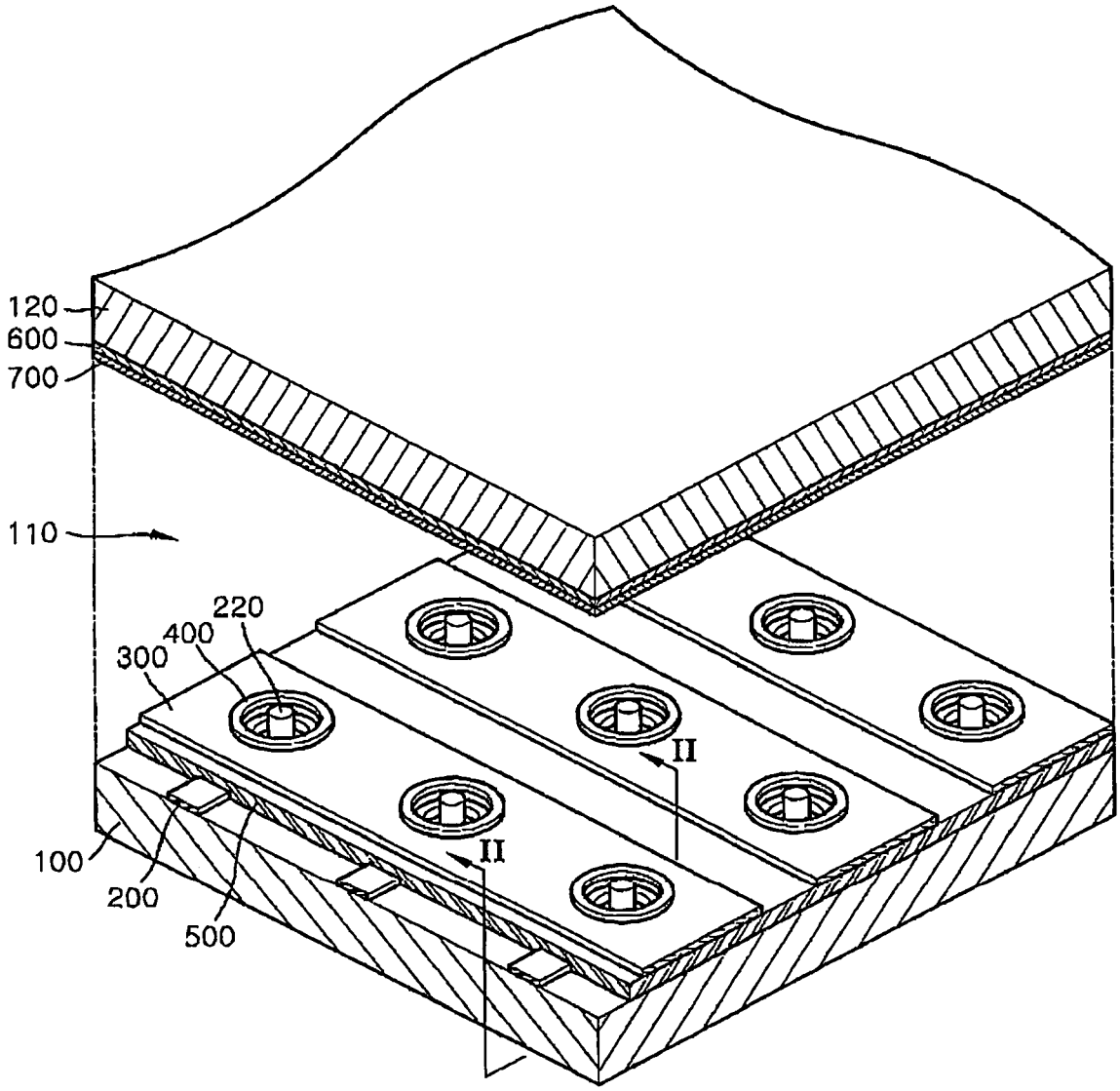
FIG. 1 illustrates an exploded view of an electron emission type backlight unit according to an exemplary embodiment of the present invention.

Korean Patent Application No. 10-2005-0068531, filed on Jul. 27, 2005, in the Korean Intellectual Property Office, and entitled: "Electron Emission Type Backlight Unit and Flat Panel Display Device Having the Same," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions and the size of components may be exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
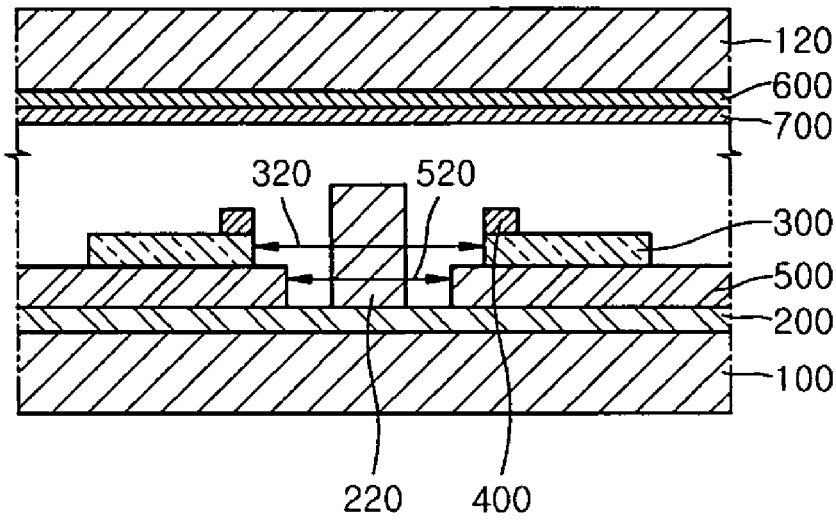
FIG. 2 illustrates a cross-sectional view taken along line II-II of FIG. 1.

FIG. 1 illustrates an exploded view of an electron emission type backlight unit according to an exemplary embodiment of the present invention. FIG. 2 illustrates a cross-sectional view taken along line II-II of FIG. 1.

Referring to FIGS. 1 and 2, the electron emission type backlight unit may include a front substrate 120 and a rear substrate 100 that face each other. An anode 600 and a light emitting unit 700 may be sequentially disposed on a bottom surface of the front substrate 120. Although the light emitting unit 700 is disposed under the anode 600 in FIGS. 1 through 2, the present invention is not limited thereto and the light emitting unit 700 may be stacked over the anode 600 without departing from the spirit and scope of the present invention The light emitting unit 700 may be made of, for example, a fluorescent or phosphorescent material. The anode 600 may be made of, for example, a metal thin film that may be disposed on a top surface of the light emitting unit 700. Alternately, a transparent electrode (not illustrated) may be disposed on a surface of the light emitting unit 700 and serve as the anode 600. The transparent electrode may be stacked over the entire surface of the front substrate or may be patterned in stripes. Of course if the transparent electrode is employed and serves as the anode, the metal thin film may be omitted, and vice versa.

In an exemplary operation, an external voltage, below a withstand voltage, may be applied to the anode 600 in order to accelerate electron beams and increase the brightness of the backlight unit.

An inner space 110 formed between the front substrate 120 and the rear substrate 100 should be maintained in a vacuum. Otherwise, particles existing between the front and rear substrates 120 and 100 and electrons emitted from the electron emitting unit 400 may collide with each other and generate ions. These ions may cause ion sputtering, may deteriorate the light emitting unit 700, and may badly affect the life and quality of the electron emission type backlight unit. Also, since electrons accelerated by the anode 600 may collide with residual particles and lose energy, these electrons may not transmit sufficient energy upon collision with the light emitting unit 700, further resulting in a reduction in luminous efficiency. Accordingly, the inner space 110 between the rear substrate 100 and the front substrate 120 may be hermetically sealed in a vacuum state along laminated ends of the front substrate 120 and the rear substrate 100.

An exemplary structure of the electron emission type backlight unit will now be explained in detail. Referring to FIG. 2, the rear substrate 100 may be made of, for example, a glass material or the like, and a gate electrode 200 may be made of, for example, a transparent conductive material, such as indium tin oxide (ITO), indium zinc oxide (IZO), $In_2O_3$, or the like, or a metal, such as Mo, Ni, Ti, Cr, W, Ag, or the like, and may be formed on the rear substrate 100. Of course, the gate electrode 200 may be made of other conductive materials.

The gate electrode 200 may have various shapes. For example, the gate electrode 200 may be patterned in stripes as illustrated in FIG. 1. Alternately, although not illustrated, the gate electrode 200 may be patterned so that two or more stripes form one stripe. In other words, the gate electrode 220 may be formed in one large stripe pattern consisting of a plurality of stripes. The ends of the stripes of the gate electrode 200 may be connected to one another so as to receive a voltage necessary for accelerating electrons emitted from the electron emitting unit 400. In this regard, the stripe-patterned gate 200 may drive the electron emission type backlight unit with less power consumed.

A glass paste, for example, may be screen-printed several times over the entire surface of the rear substrate 100 to cover the gate electrode 200 and form an insulating unit 500 made of, for example, silicon oxide or silicon nitride. Of course, the insulting unit 500 may be made of other electrically insulating materials.

The insulating unit 500 may be formed at an area where the gate electrode 200 and a cathode 300 intersect each other. Alternately, the insulating unit 500 may be larger than the area where the gate electrode 200 and the cathode 300 intersect each other. For example, when the gate electrode 200 and the cathode 300 may be patterned in stripes, the insulating unit 200 may be disposed in respective areas where the stripes of the gate electrode 200 and the stripes of the cathode 300 intersect each other. Accordingly, the insulating unit 500 is not limited to its shape or size unless, for example, an electrical short occurs.

The insulating unit 500 may have a second opening 520 formed in the area where the gate electrode 200 and the cathode 300 intersect each other. The second opening 520 may provide electrical communication between an auxiliary gate electrode 220 and the gate electrode 200. The second opening 520 may also prevent the penetration of an anode electric field into a cathode-gate electric field.

The cathode 300 may be made of a material such as nickel, cobalt, iron, gold, silver or the like, and may be stacked on a top surface of the insulating unit 500 to intersect the gate electrode 200. The cathode 300 may have various shapes, and for example, may be patterned in stripes as illustrated in FIG. 1. Alternately, the cathode 300 may be patterned so that two or more stripes form one stripe. In other words, the cathode 300 may be formed in one large stripe pattern consisting of a plurality of stripes. The ends of the stripes of the cathode 300 may be connected to one another so as to supply electrons to the electron emitting unit 400. In this regard, the stripe-patterned cathode 300 may drive the electron emission type backlight unit with less power consumed.

The cathode 300 also may have a first opening 320 formed in the area where the gate electrode 200 and the cathode 300 intersect each other. The first opening 320 may provide electrical communication between the auxiliary gate electrode 220 and the gate electrode 200. The first opening 320 may also prevent the penetration of an anode electric field into a cathode-gate electric field.

Figure 3:
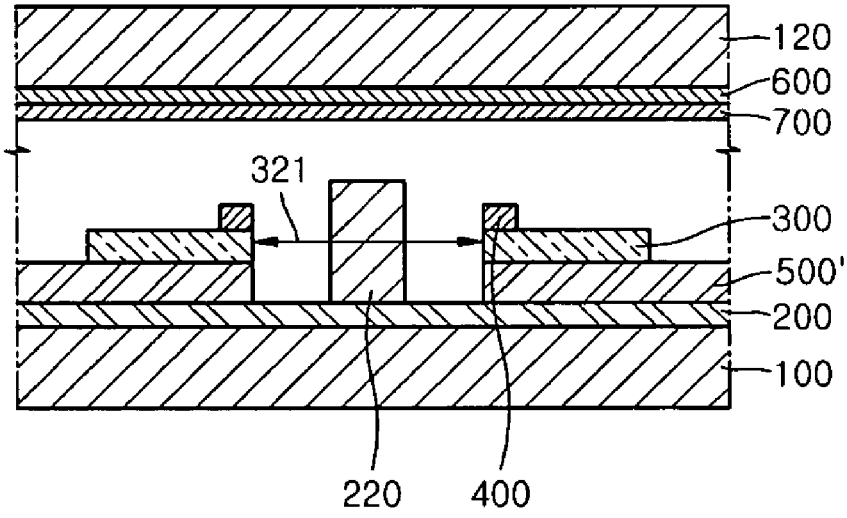
FIG. 3 illustrates a cross-sectional view of a modified electron emission type backlight unit of FIG. 2.

The first opening 320 and the second opening 520 of the insulting unit 500 may be concentric. Additionally, the first and second openings 320 and 520 may not be limited in size, unless, for example, the auxiliary gate electrode 220 contacts edges of the first and second openings 320 and 520. That is, the first opening 320 may be larger than the second opening 520 as illustrated in FIG. 2, or the first and second openings 320 and 520 may have the same diameter to form an opening 321, as illustrated in FIG. 3. However, when considering failure that may occur due to an electrical short from the gate electrode 200 during the formation of the cathode 300, the first opening 320 may be larger than the second opening 520.

The electron emitting unit 400 may be stacked on a top surface of the cathode 300 to receive electrons from the cathode 300. The electron emitting unit 400 may be disposed along an edge of the first opening 320. However, when considering that a cathode-gate electric field may be stronger at a top end or a side end of the cathode 300, the electron emitting unit 400 may be stacked along the edge of the first opening 320.

The electron emitting unit 400 may have a circular shape. Also, similar to the first and second openings 320 and 520, which may have circular shapes, the electron emitting unit 400 may have a cylindrical shape. In the cylindrical shape, the electron emitting unit 400 may be in the cathode-gate electric field produced by the auxiliary gate electrode 220. The electron emitting unit 400 is not limited to the circular or cylindrical shapes, and may have other various shapes, which will be explained later.

The electron emitting unit 400 may be made of, for example, a carbon-based material having a low work function such as carbon nanotube (CNT), graphite, diamond, diamond like carbon (DLC), fullerene (C60), carbon nanohorn or the like.

The electron emitting unit 400 may be formed, for example, by thick-film printing and patterning a carbon-based paste through drying, exposure, and development, or may be formed by chemical vapor deposition (CVD), physical vapor deposition (PVD) or the like.

The auxiliary gate electrode 220 may be disposed in the first and second openings 320 and 520. The auxiliary gate electrode 220 may prevent an anode electric field from penetrating into an electric field formed by the cathode 300 and the gate electrode 200. Additionally, the auxiliary gate electrode 220 may efficiently control electron emission due to a voltage applied to the gate electrode 200.

The auxiliary gate electrode 220 may be made of, for example, a transparent conductive material, such as ITO, IZO, $In_2O_3$, or the like, or a metal, such as Mo, Ni, Ti, Cr, W, Ag, or the like. Of course, the auxiliary gate 220 may be made of other conductive materials. In this regard, the auxiliary gate electrode 220 may be made of the same material as the gate electrode 200. However, if contact resistance, which may occur between the auxiliary gate electrode 220 and the gate electrode 200, is not critical, and interface affinity is acceptable, the conductive material of the auxiliary gate electrode 220 may be different from that of the gate electrode 200.

The auxiliary gate electrode 220 may have the same shape as the first and second openings 320 and 520. As illustrated in FIG. 1, similar to the first and second openings 320 and 520 having circular shapes, the auxiliary gate electrode 220 may have a circular or cylindrical shape. However, the auxiliary gate electrode 220 is not limited to the circular or cylindrical shape, and may have other shapes. Also, the auxiliary gate electrode 220 may not contact edges of the first and second openings 320 and 520.

In this exemplary structure, the electrons emitted from the electron emitting unit 400 may be effectively controlled by a voltage applied to the auxiliary gate electrode 220.

The rear substrate 100 and the front substrate 120 may be sealed together using, for example, a sealing material. The sealing member may be, for example, a sealing glass frit. In this case, the sealing glass frit may be in a soft state and may be coated on an edge of the rear substrate 100 using, for example, dispensing, screen printing, or the like. Any water contained in the sealing glass frit may be removed using a drying process.

The rear substrate 100 and the front substrate 120 may be aligned and the sealing glass frit may be sintered at high temperature to completely seal the rear substrate 100 and the front substrate 120. The inner space 110, between the rear substrate 100 and the front substrate 120, may be made into a vacuum state using, for example, an exhaust port (not illustrated).

In this exemplary structure, a high voltage for electron emission may be directly applied between the anode 600 and the cathode 300 without local arcing. Accordingly, a voltage may be applied, electrons may be emitted from the electron emitting unit 400 and the emitted electrons may be accelerated by an electric field formed by the anode 600 on the front substrate 120. These electrons may collide with the light emitting unit 700 to emit visible light.

FIG. 3 is a cross-sectional view of a modified electron emission type backlight unit of FIG. 2. The modified electron emission type backlight unit of FIG. 3 is different from the electron emission type backlight unit of FIG. 2 in that the opening 520 of the insulating layer 500 and the opening 320 of the cathode 300 have substantially the same diameter to form the opening 321.

However, as illustrated in FIG. 2, the insulating unit 500 and the cathode 300 may be made of, for example, different materials, and to form the openings 520 and 320, respectively, a wet or dry etching may be employed using the same etchant. In this case, the rates of etchings may be different, in view of the different materials, such that the openings 520 and 320 may have different diameters.

Alternately, the insulating unit 500 and the cathode 300 may be subjected to laser beams or ion beams to respectively form the openings 520 and 320. The portions of the insulating unit 500 and the cathode 300 exposed to the beams may have the same area. Accordingly, the openings 520 and 320 may have the same diameter, as illustrated in FIG. 3. In short, the openings 520 and 320 may have different diameters as illustrated in FIG. 2 or may have the same diameter as illustrated in FIG. 3 without departing from the spirit or scope of the present invention.

Figure 4:
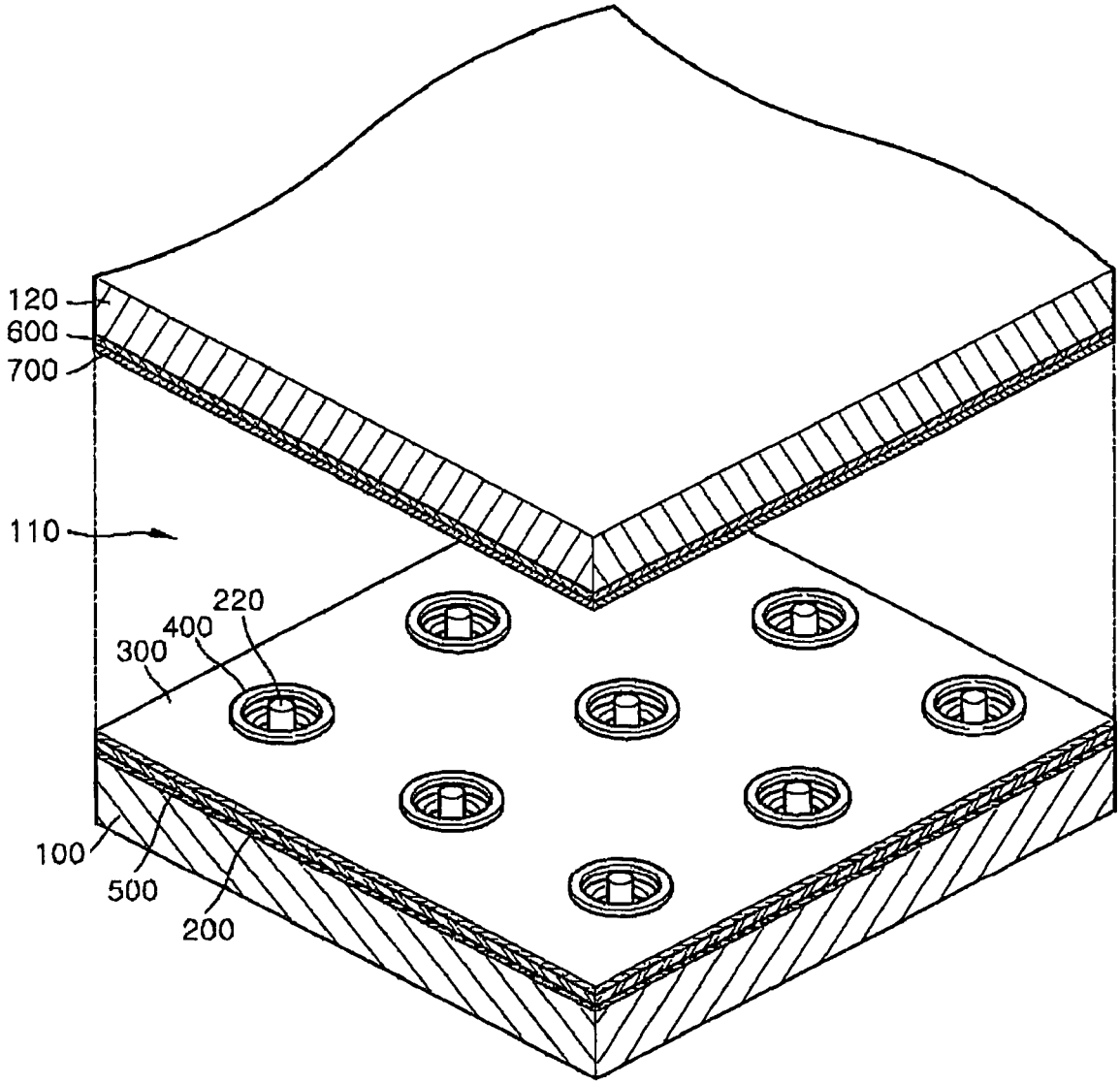
FIG. 4 illustrates an exploded view of an electron emission type backlight unit according to another exemplary embodiment of the present invention.

FIG. 4 is an exploded view of an electron emission type backlight unit according to another exemplary embodiment of the present invention. An explanation will now be made focusing on differences from the exemplary embodiment of FIGS. 1 and 2.

Referring to FIG. 4, the front substrate 120 and the rear substrate 100 face each other. The anode 600 and the light emitting unit 700 may be sequentially disposed on a bottom surface of the front substrate 120. The anode 600, the inner space 110, and the light emitting unit 700 of FIG. 4 may be equal or similar to those of FIGS. 1 and 2, and thus a detailed explanation thereof will not be given.

The rear substrate 100 may be made of, for example, a glass material or the like. The gate electrode 200 may be made of, for example, a transparent conductive material, such as ITO, IZO, $In_2O_3$, or the like, or a metal, such as Mo, Ni, Ti, Cr, W, Ag, or the like, and may be formed on a top surface of the rear substrate 100. Of course, the gate electrode 200 may be made of other conductive materials.

The gate electrode 200 may have various shapes. In the present exemplary embodiment, the gate electrode 200 may be formed over the entire top surface of the rear substrate 100, unlike the exemplary embodiment of FIGS. 1 and 2. That is, in the exemplary embodiment of FIGS. 1 and 2, the gate electrode 200 may be patterned in stripes or formed in one large stripe pattern consisting of two or more stripes. However, in the present exemplary embodiment of FIG. 4, the gate electrode 200 may be formed over the entire top surface of the rear substrate 100. Accordingly, the manufacturing process may be simplified and the rate of defects may be reduced.

A glass paste, for example, may be screen-printed several times over the entire surface of the rear substrate 100 to cover the gate electrode 200, and form the insulating unit 500 made of, for example, silicon oxide or silicon nitride. Of course, the insulating unit 500 may be made of other electrically insulating materials.

The insulating unit 500 may be formed at an area where the gate electrode 200 and the cathode 300 intersect each other. Alternately, the insulating unit 500 may be larger than the area where the gate electrode 200 and the cathode 300 intersect each other. Accordingly, the insulating unit 500 is not limited to its shape or size, unless, for example, an electrical short occurs.

The insulating unit 500 may have the second opening 520 formed in the area where the gate electrode 200 and the cathode 300 intersect each other. The second opening 520 of FIG. 4 may be equal or similar to that of FIGS. 1 and 2, and thus a detailed explanation thereof will not be given.

The cathode 300 may be made of a material such as nickel, cobalt, iron, gold, silver, or the like, and may be stacked on a top surface of the insulating unit 500 to intersect the gate electrode 200. As illustrated in FIG. 4, the cathode 300 may be formed over the entire top surface of the rear substrate 100.

The cathode 300 in the exemplary embodiment of FIGS. 1 and 2 may have various shapes, for example, may be patterned in stripes. Alternately, the cathode 300 of FIGS. 1 and 2 may be formed in one large pattern consisting of two or more stripes, and the ends of the stripes of the cathode 300 may be connected to one another to receive a voltage. However, the cathode 300 in the present exemplary embodiment of FIG. 4 may be formed over the entire top surface of the rear substrate 100. Accordingly, the manufacturing process may be simplified and the rate of defects may be reduced.

The cathode 300 may have the first opening 320 formed in the area where the gate electrode 200 and the cathode 300 intersect each other. The first opening 320 of FIG. 4 may be equal or similar to that of the exemplary embodiment illustrated in FIGS. 1 and 2, and thus a detailed explanation thereof will not be given. The first opening 320 and the second opening 520 of the insulating unit 500 may be concentric.

The electron emitting unit 400 may be stacked on a top surface of the cathode 300 to receive electrons from the cathode 300. The electron emitting unit 400 of FIG. 4 may be equal or similar to that of the exemplary embodiment illustrated in FIGS. 1 and 2, and thus a detailed explanation thereof will not be given.

Also, the shape of the auxiliary gate electrode 220 may be equal or similar to that of the exemplary embodiment illustrated in FIGS. 1 and 2, and thus a detailed explanation thereof will not be given.

The rear substrate 100 and the front substrate 120 may be sealed together using, for example, a sealing member. The sealing member may be equal or similar to that of the exemplary embodiment illustrated in FIGS. 1 and 2, and thus a detailed explanation thereof will not be given.

In this exemplary structure, a high voltage for electron emission may be directly applied between the anode 600 and the cathode 300 without local arcing. Accordingly, a voltage may be applied, electrons may be emitted from the electron emitting unit 400 and the emitted electrons may be accelerated by an electric field formed by the anode 600 on the front substrate. These electrons may collide with the light emitting unit 700 to emit visible light.

Figure 5:
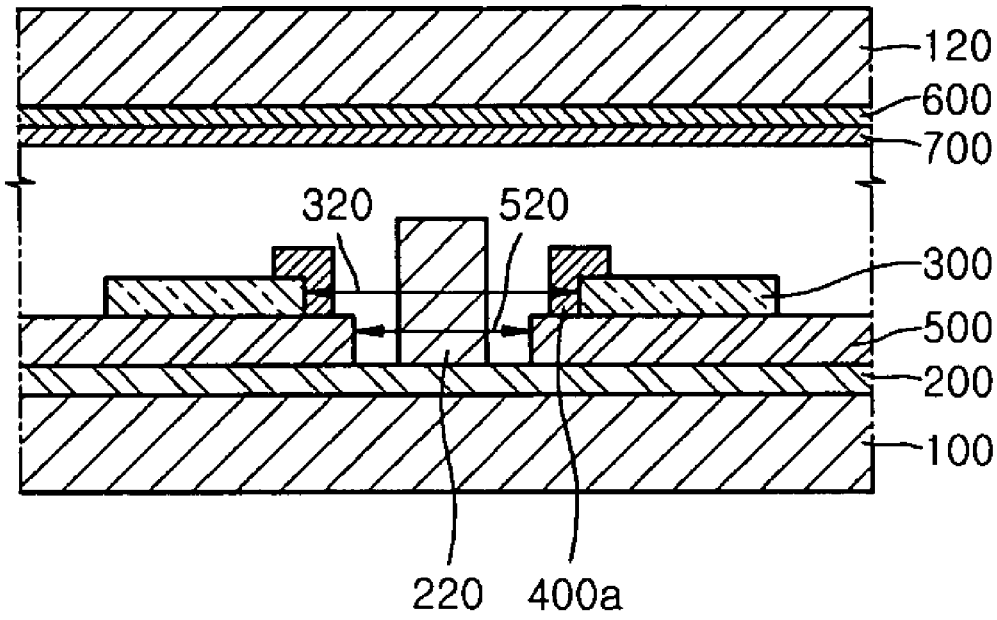
FIG. 5 illustrates a cross-sectional view of a modified electron emission type backlight unit of FIG. 2.

FIG. 5 illustrates a cross-sectional view of a modified electron emission type backlight unit of FIG. 2. An explanation will now be made focusing on differences from the electron emission type backlight unit of FIGS. 1 and 2.

Referring to FIG. 5, the front substrate 120 and the rear substrate 100 may face each other, and the anode 600 and the light emitting unit 700 may be sequentially stacked on a bottom surface of the front substrate 120.

The anode 600 may be made of, for example, a metal thin film as described above, and thus a detailed explanation thereof will not be given. A transparent electrode (not illustrated) made of, for example, ITO may be disposed on a surface of the light emitting unit 700. In this case, the metal thin film may be omitted, and the transparent electrode may serve as an anode for receiving a voltage necessary for electronic beam acceleration, and vice versa. The order of stacking the anode 600 and the light emitting unit 700 may be changed without departing from the spirit and scope of the present invention.

The inner space 110 may be formed between the front substrate 120 and the rear substrate 100 with a predetermined distance between them. The inner space 110 should be maintained in a vacuum state as described above, and thus a detailed explanation thereof will not be given.

The rear substrate 100 may be made of, for example, a glass material, and the gate electrode 200 may be made of a transparent conductive material, such as ITO, IZO, or $In_2O_3$, or the like or a metal, such as Mo, Ni, Ti, Cr, W, Ag, or the like, and may be formed on the rear substrate 100. The gate electrode 200 may be made of other conductive materials.

The gate electrode 200 may have various shapes. For example, the gate electrode 200 may be patterned in stripes as illustrated in FIG. 1. Also, the gate electrode 200 may be formed in one large stripe pattern consisting of two or more stripes. The ends of the stripes of the gate electrode 200 may be connected to one another. Alternately, the gate electrode 200 may be formed over the entire surface of the rear substrate 100 facing the front substrate 120 as described above with reference to FIG. 4.

A glass paste, for example, may be screen-printed several times over the entire surface of the rear substrate 100 to cover the gate electrode 200 and form the insulating unit 500 made of, for example, silicon oxide or silicon nitride. Of course, the insulating unit 500 may be made of other electrically insulating materials.

The insulating unit 500 may be equal or similar to that described in the previous exemplary embodiments, and thus a detailed explanation thereof will not be given. The insulating unit 500 may have the second opening 520 formed in an area where the gate electrode 200 and the cathode 300 intersect each other.

The cathode 300 may be made of a material such as nickel, cobalt, iron, gold, silver or the like, and may be stacked on a top surface of the insulating unit 500 to intersect the gate electrode 200.

The cathode 300 may be patterned in stripes. The cathode 300 may have various shapes, and for example, may be patterned in stripes as illustrated in FIG. 1. The cathode 300 may be formed in one large stripe pattern consisting of two or more stripes. The ends of the stripes of the cathode 300 may be connected to one another. Alternately, the cathode 300 may be formed over the entire surface of the rear substrate 100 as described above, and thus a detailed explanation will not be given.

The cathode 300 may have the first opening 320 in the area where the gate electrode 200 and the cathode 300 intersect each other. The first opening 320 may be equal or similar to that of FIGS. 1 and 2, and thus a detailed explanation will not be given.

An electron emitting unit 400*a* may be formed on a top surface of the cathode 300. Considering that a cathode-gate electric field may be stronger at a top end or side end of the cathode 300, the electron emitting unit 400*a* may be coated along an edge of the first opening 320 to cover the top end and the side end of the cathode 300. Thus, the electron emitting unit 400 of FIGS. 1 and 2 may be stacked on the end of the cathode 300. However, the electron emitting unit 400*a* of FIG. 5 may be stacked on both the top end and the side end of the cathode 300.

The electron emitting unit 400*a* may have a circular shape. Accordingly, electrons emitted from the electron emitting unit 400*a* may be efficiently controlled by a cathode-gate electric field produced by the auxiliary gate electrode 220. The other feature of the electron emitting unit 400*a* may be the same or similar to that of FIGS. 1 and 2, and thus a detailed explanation will not be given.

The auxiliary gate electrode 220 may be disposed in the first and second openings 320 and 520. The other feature of the auxiliary gate electrode 220 may be the same or similar to that of FIGS. 1 and 2, and thus a detailed explanation thereof will not be given.

In this exemplary structure, the electrons that may be emitted from the electron emitting unit 400*a* may be effectively controlled by a voltage applied to the auxiliary gate electrode 220.

The rear substrate 100 and the front substrate 120 may be sealed together using, for example, a sealing member.

In this exemplary structure, a high voltage for electron emission may be directly applied between the anode 600 and the cathode 300 without local arcing. Accordingly, a voltage may be applied, electrons may be emitted from the electron emitting unit 400*a*, and the emitted electrons may be accelerated by an electric field formed by the anode 600 on the front substrate 120. These electrons may collide with the light emitting unit 700 to emit visible light.

Figure 6:
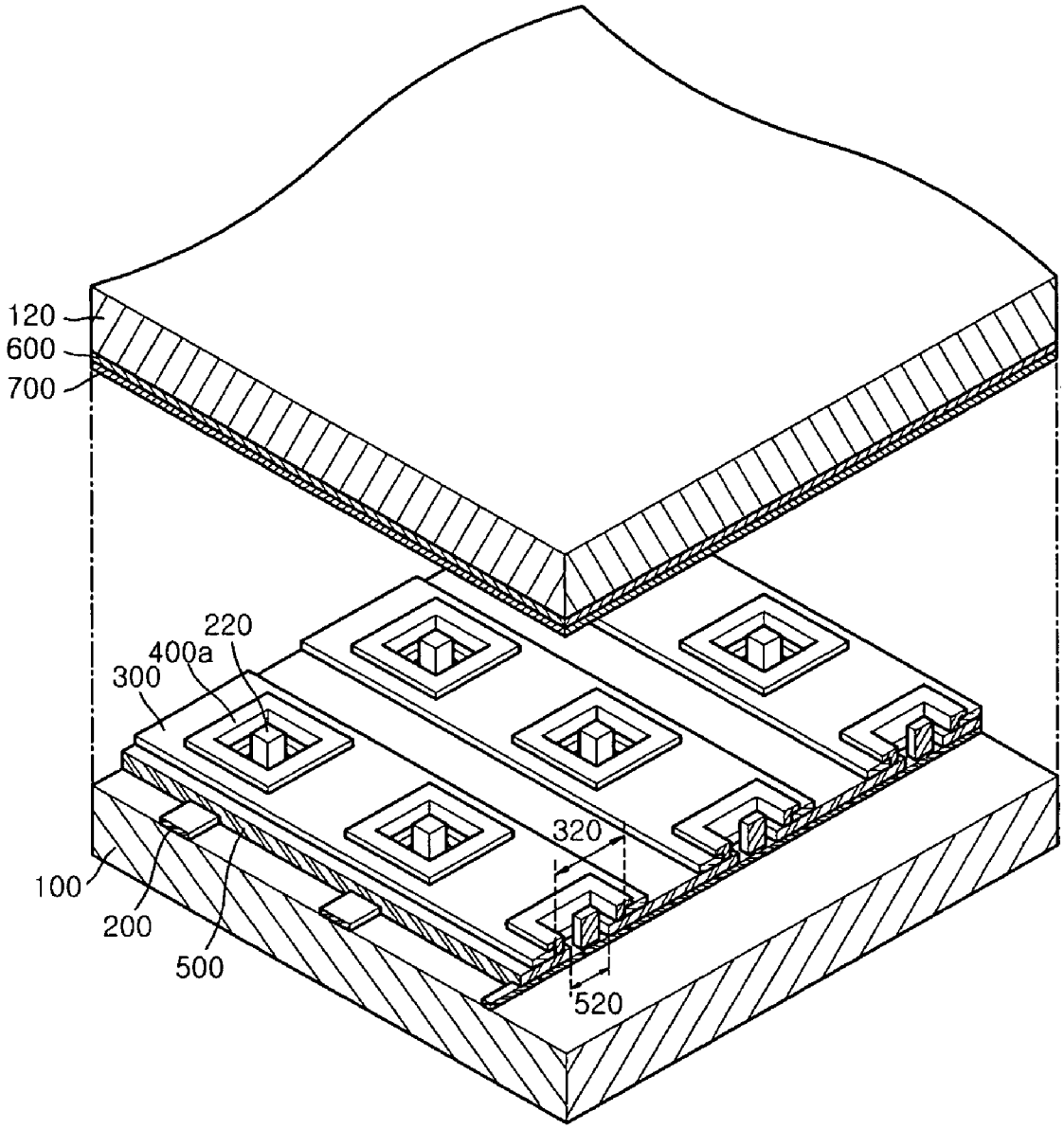
FIG. 6 illustrates an exploded view of an electron emission type backlight unit according to still another exemplary embodiment of the present invention.

FIG. 6 illustrates an exploded view of an electron emission type backlight unit according to still another exemplary embodiment of the present invention. The front substrate 120, the anode 600, and the light emitting unit 700 may be the same or similar to those described in the previous exemplary embodiments of FIGS. 1 through 5, and thus a detailed explanation thereof will not be given.

Referring to FIG. 6, the rear substrate 100 may be made of, for example, a glass material or the like, and the gate electrode 200 may be made of, for example, a transparent conductive material, such as ITO, IZO, or $In_2O_3$, or the like, or a metal, such as Mo, Ni, Ti, Cr, W, or Ag, or the like, and may be formed on the rear substrate 100. Of course, the gate electrode 200 may be made of other conductive materials.

The gate electrode 200 may have various shapes. For example, the gate electrode 200 may be patterned in stripes as illustrated in FIG. 1. Alternately, the gate electrode 200 may be formed over the entire surface of the rear substrate 100 facing the front substrate 120 as described above, and thus a detailed explanation thereof will not be given.

A glass paste, for example, may be screen-printed several times over the entire surface of the rear substrate 100 to cover the gate electrode 200 and form the insulating unit 500 made of, for example, silicon oxide or silicon nitride. Of course, the insulating unit 500 may be made of other electrically insulting materials.

The other features of the insulating unit 500 may be the same or similar to as those of the exemplary embodiments of FIGS. 1 through 5, and thus a detailed explanation thereof will not be given. The insulating unit 500 may have the second opening 520 in an area where the gate electrode 200 and the cathode 300 intersect each other.

The second opening 520 may have a square shape. The square second opening 520 may provide electrical communication between the auxiliary gate electrode 220 and the gate electrode 200. The second opening 520 may also prevent an anode electric field from penetrating into a cathode-gate electric field. However, the second opening 520 is not limited to the square shape, and may have, for example, closed curve shapes such as circle, oval, star, or the like.

The cathode 300 may be made of a material such as nickel, cobalt, iron, gold, silver or the like, and may be stacked on a top surface of the insulating unit 500 to intersect the gate electrode 200. The cathode 300 may be patterned in stripes. The cathode 300 may have various shapes, and for example, may be patterned in stripes as illustrated in FIG. 1. Alternately, the cathode 300 may be formed over the entire surface of the rear substrate 100 as described above, and thus a detailed explanation thereof will not be given. The cathode 300 may have the first opening 320 in the area where the gate electrode 200 and the cathode 300 intersect each other.

The first opening 320 may have the same shape as the second opening 520. In the present exemplary embodiment, the second opening 520 may have a square shape, and the first opening 320 also may have a square shape. However, the first and second openings 320 and 520 are not limited to the square shapes, and may have, for example, closed curve shapes such as circle, oval, star or the like. Additionally, the first opening 320 may have a different shape from the shape of the second opening 520 if, for example, the auxiliary gate electrode 220 communicates with the gate electrode 200.

The first opening 320 may provide electrical communication between the auxiliary gate electrode 220 and the gate electrode 200. The first opening 320 may also prevent an anode electric field from penetrating into a cathode-gate electric field.

The first opening 320 and the second opening 520 of the insulating unit 500 may be concentric. The first and second openings 320 and 520 may have various sizes unless, for example, the auxiliary gate electrode 220 contacts edges of the first and second openings 320 and 520.

The electron emitting unit 400*a* may be stacked on a top surface of the cathode 300 to receive electrons emitted from the cathode 300. The electron emitting unit 400*a* may be disposed along an edge of the first opening 320. However, when considering that a cathode-gate electric field may be stronger at a top end or side end of the cathode 300, the electron emitting unit 400*a* may be coated along the edge of the first opening 320 to cover the top end and the side end of the cathode 300.

The electron emitting unit 400*a* may have a square shape. Similar to the first and second openings 320 and 520 that may have square shapes, the electron emitting unit 400*a* may have a square or square pillar shape to be efficiently present in a cathode-gate electric field produced by the auxiliary gate electrode 520. However, the electron emitting unit 400*a* is not limited to the square or square pillar shape, and may have, for example, closed curve shapes such as circle, oval, star, or the like. The other features of the electron emitting unit 400*a* may be the same or similar to those described in FIGS. 1 through 5, and thus a detailed explanation thereof will not be given.

The auxiliary gate electrode 220 may be disposed in the first and second openings 320 and 520. The auxiliary gate electrode 220 may prevent an anode electric field from penetrating into an electric field formed by the cathode 300 and the gate electrode 200 and may control electron emission due to a voltage applied to the gate electrode 200.

The auxiliary gate electrode 220 may be made of, for example, a transparent conductive material, such as ITO, IZO, $In_2O_3$, or the like, or a metal, such as Mo, Ni, Ti, Cr, W, Ag, or the like. Of course, the auxiliary gate 220 may be made of other conductive materials. In this regard, the auxiliary gate electrode 220 may be made of the same material as the gate electrode 200. However, if contact resistance, which may occur between the auxiliary gate electrode 220 and the gate electrode 200, is not critical, and interface affinity is acceptable, the conductive material of the auxiliary gate electrode 220 may be different from that of the gate electrode 200.

The auxiliary gate electrode 220 may have the same shape as the first and second openings 320 and 520. Similar to the first and second openings 320 and 520 that may have square shapes, the auxiliary gate electrode 220 may have a square or square pillar shape. However, the auxiliary gate electrode 220 is not limited to the square or square pillar shape, and may have, for example, closed curve shapes such as circle, oval, star or the like. Further, the auxiliary gate electrode 220 may not contact edges of the first and second openings 320 and 520.

The rear substrate 100 and the front substrate 120 may be sealed together using, for example, a sealing material. The sealing material may be the same or similar to that of FIGS. 1 through 5, and thus a detailed explanation thereof will not be given.

In this exemplary structure, a high voltage for electron emission may be directly applied between the anode 600 and the cathode 300 without local arcing. Accordingly, a voltage may be applied, electrons may be emitted from the electron emitting unit 400*a*, and the emitted electrons may be accelerated by an electric field formed by the anode 600 on the front substrate 120. These electrons may collide with the light emitting unit 700 to emit visible light.

Figure 7:
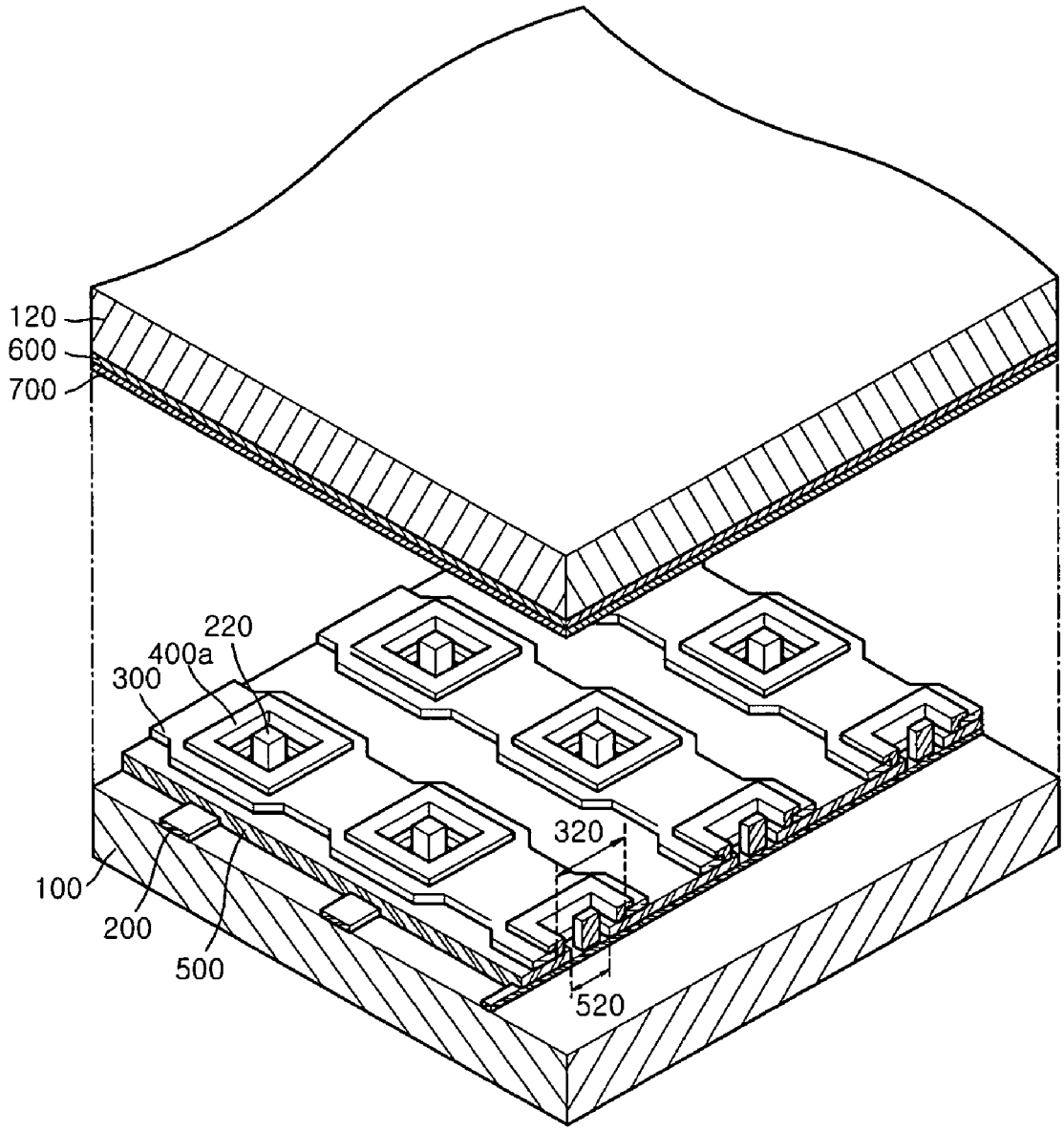
FIG. 7 illustrates an exploded view of an electron emission type backlight unit according to yet another exemplary embodiment of the present invention.

FIG. 7 illustrates an exploded view of an electron emission type backlight unit according to yet another exemplary embodiment of the present invention. The front substrate 120, the anode 600, and the light emitting unit 700 may be the same as those of FIGS. 1 through 6, and thus a detailed explanation will not be given.

Referring to FIG. 7, the rear substrate 100 may be made of, for example a glass material or the like, and the gate electrode 200 may be made of a transparent conductive material, such as ITO, IZO, $In_2O_3$, or the like, or a metal, such as Mo, Ni, Ti, Cr, W, Ag, or the like, and may be formed on the rear substrate 100.

The gate electrode 200 may have various shapes. For example, the gate electrode 200 may be patterned in stripes as illustrated in FIG. 7. However, the gate electrode 200 may be formed over the entire surface of the rear substrate 100 as described above, and thus a detailed explanation thereof will not be given.

A glass paste, for example, may be screen-printed several times over the entire surface of the rear substrate 100 to cover the gate electrode 200 and form the insulating unit 500 made of, for example, silicon oxide or silicon nitride. Of course, the insulating unit 500 may be made of other electrically insulating materials.

The other features of the insulating unit 500 may be the same or similar to those described in FIGS. 1 through 6, and thus a detailed explanation thereof will not be given. The insulating unit 500 may have the second opening 520 in an area where the gate electrode 200 and the cathode 300 intersect each other.

The second opening 520 may have a square shape. However, the second opening 520 is not limited to the square shape, and may have, for example, closed curve shapes such as circle, oval, star or the like.

The cathode 300 made of a material such as nickel, cobalt, iron, gold, silver or the like, and may be stacked on a top surface of the insulating unit 500 to intersect the gate electrode 200. The cathode 300 may be patterned in stripes or formed in one large stripe pattern consisting of two or more stripes. Additionally, the ends of the stripes of the cathode 300 may have curved shapes, as illustrated in FIG. 7.

The cathode 300 may be formed around the first opening 320 and may have the same shape as the first opening 320. The cathode 300 may be patterned to allow electrical communication in a direction where the stripes may be formed. The first opening 320 may have, for example, a square shape and the opening formed on the cathode 300 may also have a square shape. However, the cathode 300 may be patterned to have a different shape from the first opening 320, if, for example, the electron emitting unit 400*a* may be stacked around the first opening 320. That is, if the electron emitting unit 400*a* may be stacked to emit electrons and the cathode 300 may allow electrical communication, the cathode 300 may have any shape.

The cathode 300 may have the first opening 320 in an area where the gate electrode 200 and the cathode 300 intersect each other.

The first opening 320 may have the same shape as the second opening 520. In the present exemplary embodiment, the second opening 520 may have a square shape and the first opening 320 also may have a square shape. However, the first and second openings 320 are not limited to the square shapes, and may have, for example, closed curve shapes such as circle, oval, star, or the like. Additionally, the first opening 320 and the second opening 520 may have different shapes as described above, and thus a detailed explanation thereof will not be given.

The first opening 320 and the second opening 520 of the insulating unit 500 may be concentric. However, the first and second openings 320 and 520 may not be limited in size unless, for example, the auxiliary gate electrode 220 contacts edges of the first and second openings 320 and 520.

The electron emitting unit 400*a* may be stacked on a top surface of the cathode 300 to receive electrons from the cathode 300. The electron emitting unit 400*a* may be disposed along an edge of the first opening 320. However, when considering that a cathode-gate electric field may be stronger at a top end or a side end of the cathode 300, the electron emitting unit 400*a* may be coated along the first opening 320 to cover the top end and the side end of the cathode 300.

The electron emitting unit 400*a* may have a square shape. Similar to the first and second openings 320 and 520 that may have square shapes, the electron emitting unit 400*a* may have a square or square pillar shape to be efficiently present in a cathode-gate electric field produced by the auxiliary gate electrode 520. However, the electron emitting unit 400*a* is not limited to the square or square pillar shape, and may have, for example, closed curve shapes, such as circle, oval, star or the like. The other features of the electron emitting unit 400*a* may be the same or similar to those described in FIGS. 1 through 6, and thus a detailed explanation thereof will not be given.

The auxiliary gate electrode 220 may be disposed in the first and second openings 320 and 520. The auxiliary gate electrode 220 may prevent an anode electric field from penetrating into an electric field formed by the cathode 300 and the gate electrode 200. Additionally, the auxiliary gate electrode 220 may control electron emission due to a voltage applied to the gate electrode 200.

The auxiliary gate electrode 220 may be made of, for example, a transparent conductive material, such as ITO, IZO, $In_2O_3$, or the like, or a metal, such as Mo, Ni, Ti, Cr, W, Ag, or the like. Of course, the auxiliary gate 220 may be made of other conductive materials. In this regard, the auxiliary gate electrode 220 may be made of the same material as the gate electrode 200. However, if contact resistance, which may occur between the auxiliary gate electrode 220 and the gate electrode 200, is not critical, and interface affinity is acceptable, the conductive material of the auxiliary gate electrode 220 may be different from that of the gate electrode 200.

The auxiliary gate electrode 220 may have the same shape as the first and second openings 320 and 520. Similar to the first and second openings 320 and 520 having square shapes, the auxiliary gate electrode 220 may have a square or square pillar shape. However, the auxiliary gate electrode 220 is not limited to the square or square pillar shape, and may have, for example, closed curve shapes such as circle, oval, star or the like. Furthermore, the auxiliary gate electrode 220 may have a size so that the auxiliary gate electrode 220 does not contact edges of the first and second openings 320 and 520.

The rear substrate 100 and the front substrate 120 may be sealed using, for example, a sealing member. The sealing member may be the same or similar to those described in FIGS. 1 through 6, and thus a detailed explanation thereof will not be given.

In this exemplary structure, a high voltage for electron emission may be directly applied between the anode 600 and the cathode 300 without local arcing. Accordingly, a voltage may be applied, electrons may be emitted from the electron emitting unit 400*a*, and the emitted electrons may be accelerated by an electric field formed by the anode 600 on the front substrate 120. These electrons may collide with the light emitting unit 700 to emit visible light.

Figure 8:
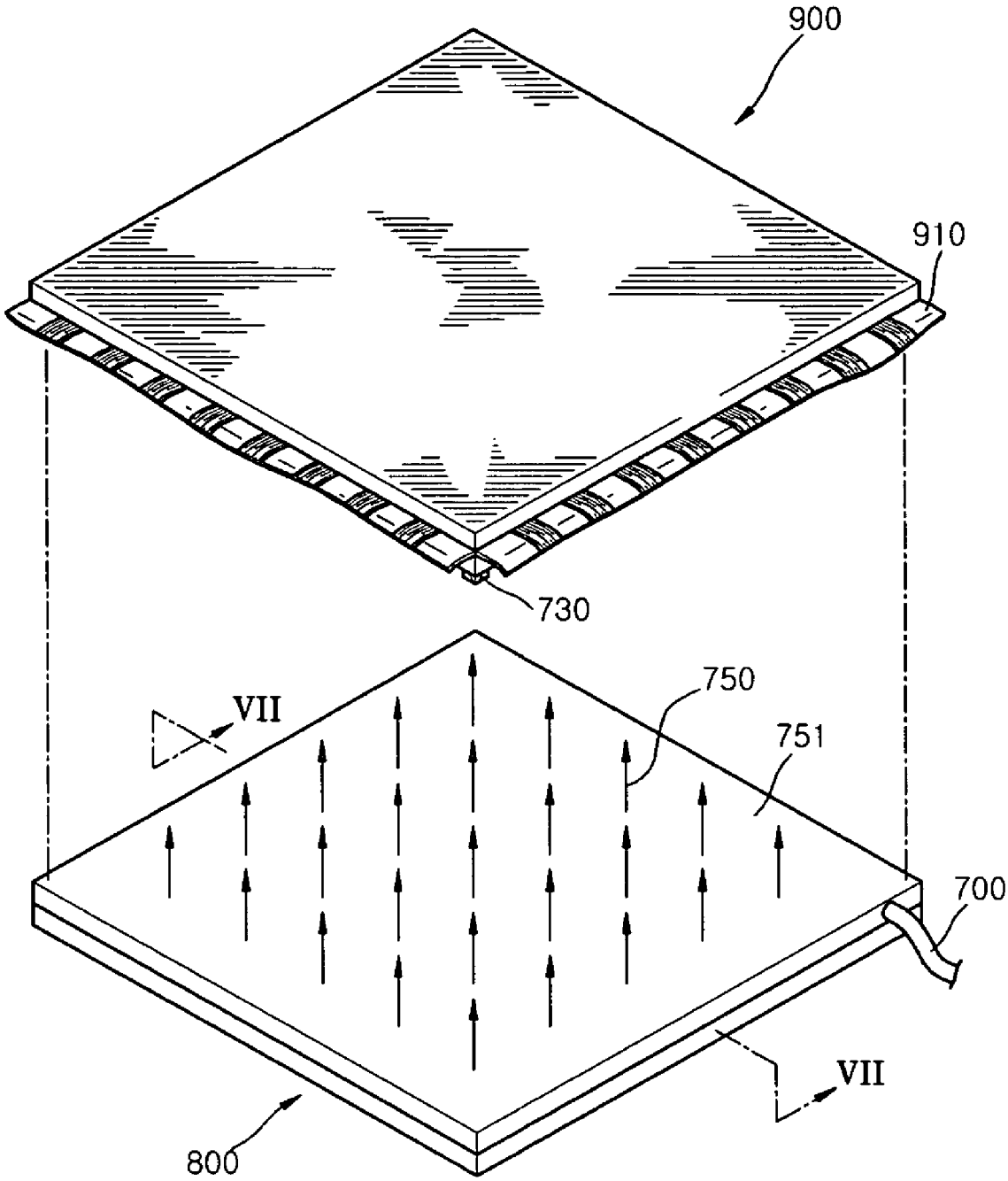
FIG. 8 illustrates an exploded view of an electron emission type backlight unit and a flat panel display according to an exemplary embodiment of the present invention.
Figure 9:
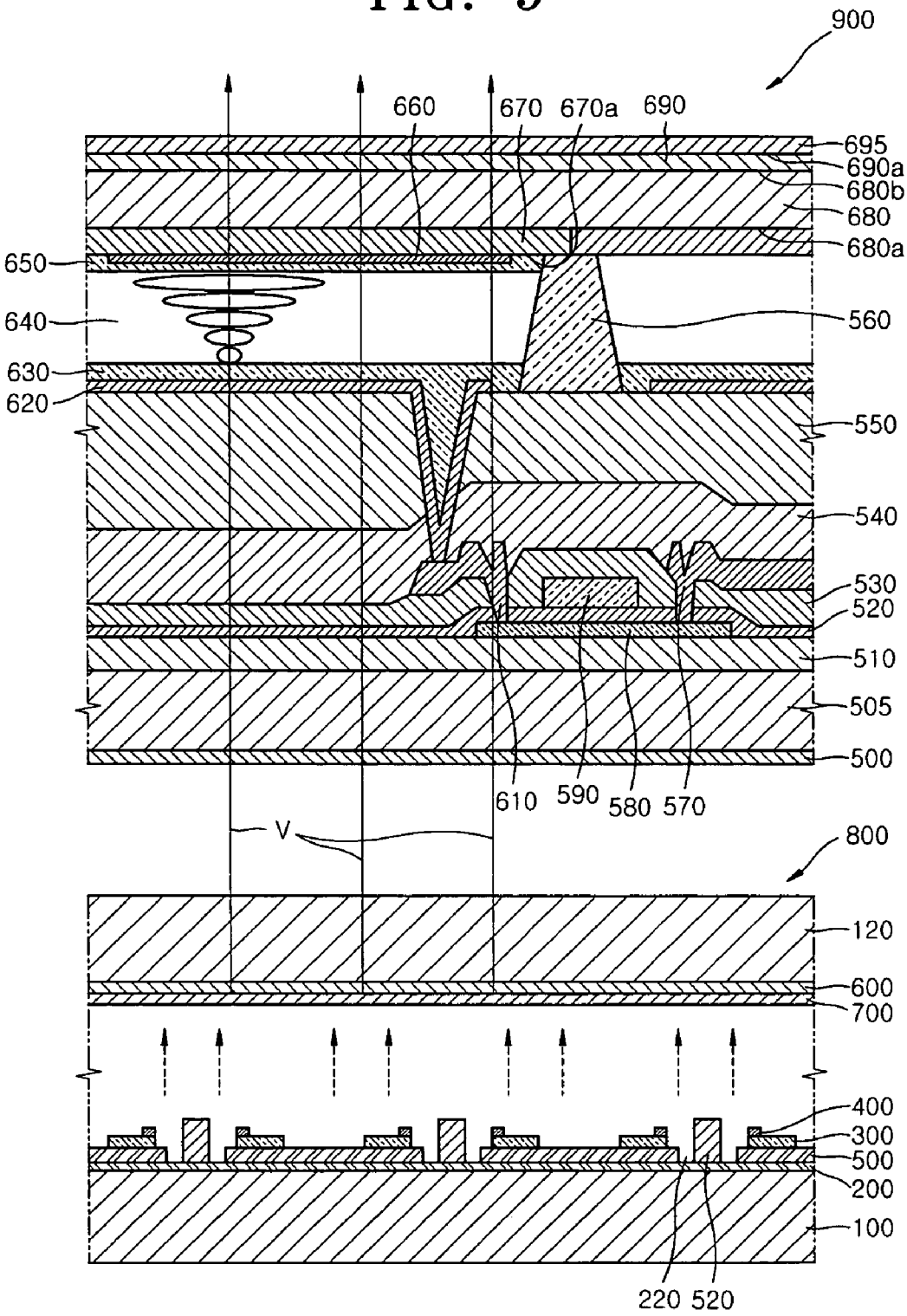
FIG. 9 illustrates a partially enlarged cross-sectional view taken along line VII-VII of FIG. 8.

FIGS. 8 and 9 illustrate an exploded view and a partial cross-sectional view, respectively, of an exemplary flat panel display device, such as an exemplary liquid crystal display panel, employing an electron emission unit as a backlight unit according to an exemplary embodiment of the present invention.

Referring to FIG. 8, an electron emission type backlight unit 800 may supply light to a liquid crystal display panel 900 of the liquid crystal display device. A flexible printed circuit board 910 may transmit an image signal to the liquid crystal display panel 900. The flexible printed circuit board 910 may be attached to the liquid crystal display panel 900. The electron emission type backlight unit 800 may be disposed to the back of the liquid crystal display panel 900.

The electron emission type backlight unit 800 may receive power through a connecting cable 700, may discharge light 750 through a front surface 751 of the backlight unit 800, and may supply the light 750 to the liquid crystal display panel 900.

The electron emission type backlight unit 800 and the liquid crystal display panel 900 will now be explained with reference to FIG. 9. The electron emission type backlight unit 800 of FIG. 8 may be the electron emission type backlight unit according to the previous exemplary embodiments of the present invention.

Referring to FIG. 9, for purposes of discussion, the electron emission type backlight unit 800 may be the electron emission type backlight unit described in the exemplary embodiment of FIGS. 1 and 2. Of course, the electron emission type backlight unit 800 may be the electron emission type backlight unit described in the other exemplary embodiments, as well.

In an exemplary operation, external power may be applied and an electric field may be formed between the cathode 300 and the gate electrode 200. The cathode 300 may supply electrons, which may be discharged from the electron emitting unit 400. The discharged electrons may collide with the light emitting unit 700 to generate visible light V. The visible light may be emitted toward the liquid crystal display panel 900.

The exemplary liquid crystal display panel 900 may include a first substrate 505, a buffer layer 510 may be formed on the first substrate 505, and a semiconductor layer 580 may be formed in a predetermined pattern on the buffer layer 510. A first insulating layer 520 may be formed on the semiconductor layer 580, a gate electrode 590 may be formed in a predetermined pattern on the first insulating layer 520, and a second insulating layer 530 may be formed on the gate electrode 590. The first and second insulating layers 520 and 530 may be etched by dry etching to expose a part of the semiconductor layer 580. A source electrode 570 and a drain electrode 610 may be formed in a predetermined area including the exposed part. A third insulating layer 540 may be formed, and a planarization layer 550 may be formed on the third insulating layer 540. A first electrode 620 may be formed in a predetermined pattern on the planarization layer 550, and a part of the third insulating layer 540 and the planarization layer 550 may be etched to form a conductive path between the drain electrode 610 and the first electrode 620. A transparent second substrate 680 may be separately manufactured from the first substrate 505, and a color filter layer 670 may be formed on a bottom surface 680*a* of the second substrate 680. A second electrode 660 may be formed on a bottom surface 670*a* of the color filter layer 670, and a first alignment layer 630 and a second alignment layer 650 facing a liquid crystal layer 640 may be respectively formed on the first electrode 620 and the second electrode 660. A first polarization layer 500 may be formed on a bottom surface of the first substrate 505, and a second polarization layer 690 may be formed on a top surface 680*b* of the second substrate 680. A protective film 695 may be formed on a top surface 690*a* of the second polarization layer 690. A spacer 560 partitioning the liquid crystal layer 640 may be formed between the color filter layer 670 and the planarization layer 550.

An exemplary operation of the liquid crystal display panel 900 will now be explained briefly. A potential difference may be generated between the first electrode 620 and the second electrode 660 due to an external signal controlled by the gate electrode 590, the source electrode 570, and the drain electrode 610. The arrangement of the liquid crystal layer 640 may be determined by the potential difference. Visible light V supplied by the backlight unit 800 may be blocked or transmitted according to the arrangement of the liquid crystal layer 640. The transmitted light may pass through the color filter layer 670 and may radiate color, thereby realizing an image.

Although the exemplary liquid crystal display panel 900 is a thin film transistor-liquid crystal display (TFT-LCD) in FIG. 9, the liquid crystal display panel 900 is not limited thereto, and may be other various light receiving display panels. The liquid crystal display panel 900 employing the exemplary electron emission unit as a backlight unit may have enhanced image brightness and prolonged life, given the improved brightness and prolonged life of the electron emission type backlight unit 800.

Although the electron emission device of the present invention may be used as the backlight unit, the electron emission device of the present invention may be used as an electron emission display device that may produce an image as well. That is, since the cathode and the gate electrode intersect each other, pixels may be defined. For example, the area where the cathode and the gate electrode intersect may be selected and a luminescent layer, for example, a fluorescent layer corresponding to a proper color may be disposed on a surface of the anode corresponding to the selected area. Therefore, three intersectional areas or three groups of intersectional areas may define a pixel that may have a Red, Green, and Blue light source. Since the electron emission display device may effectively block an anode electric field, gradation may be obtained by controlling a voltage applied to the gate electrode.

As described above, the electron emission type backlight unit and the flat panel display device employing the same according to the present invention may have the following advantages.

A strong electric field may be uniformly formed using the electron emitting unit, and brightness and uniformity may be improved, direct arcing between the cathode and the anode may be avoided, and the deterioration of the electron emitting units may be prevented.

Also, the electron emitting unit may operate without an undue increase in temperature so that the life of the light emitting unit may be extended.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An electron emission type backlight unit, comprising:

a front substrate and a rear substrate facing each other;

a gate electrode disposed on the rear substrate;

an insulating unit disposed on the gate electrode;

a cathode disposed on the insulating unit and intersecting the gate electrode, wherein the cathode includes a first opening exposing the gate electrode;

the insulating unit includes a second opening exposing the gate electrode, wherein the second opening communicates with the first opening;

an electron emitting unit disposed on the cathode exposing the gate electrode, wherein the electron emitting unit traces along a boundary of the cathode that defines the first opening;

an auxiliary gate electrode disposed on the gate electrode, wherein the auxiliary gate electrode protrudes through the first opening and the second opening; and an anode and a light emitting unit disposed on the front substrate.

2. The electron emission type backlight unit as claimed in claim 1, wherein the gate electrode and the cathode cross each other.

3. The electron emission type backlight unit as claimed in claim 1, wherein the gate electrode is patterned in two or more stripes.

4. The electron emission type backlight unit as claimed in claim 3, wherein ends of the stripes of the gate electrode are electrically connected to each other.

5. The electron emission type backlight unit as claimed in claim 1, wherein the gate electrode is on a top surface of the rear substrate and a bottom surface of the gate electrode is not larger than the top surface of the rear substrate.

6. The electron emission type backlight unit as claimed in claim 1, wherein the insulating unit is larger than an area where the gate electrode and the cathode intersect each other.

7. The electron emission type backlight unit as claimed in claim 1, wherein the auxiliary gate electrode has the same shape as the first or second openings and has a diameter smaller than the diameters of each of the first and second openings.

8. The electron emission type backlight unit as claimed in claim 1, wherein the auxiliary gate electrode is taller than the electron emitting unit.

9. The electron emission type backlight unit as claimed in claim 1, wherein the cathode is patterned in two or more stripes.

10. The electron emission type backlight unit as claimed in claim 9, wherein ends of the stripes of the cathode have curved shapes.

11. The electron emission type backlight unit as claimed in claim 1, wherein the cathode is on a top surface of the rear substrate and a bottom surface of the cathode is not larger than the top surface of the rear substrate.

12. The electron emission type backlight unit as claimed in claim 1, wherein the first opening is defined as a closed shape, the closed shape including a circle shape, an oval shape, a square shape, or a star shape.

13. The electron emission type backlight unit as claimed in claim 1, wherein the first opening is larger in diameter than the second opening.

14. The electron emission type backlight unit as claimed in claim 13, wherein the first opening and the second opening are substantially concentric.

15. The electron emission type backlight unit as claimed in claim 1, wherein the first opening and the second opening have substantially the same diameter and are substantially concentric.

16. The electron emission type backlight unit as claimed in claim 15, wherein the first opening and the second opening have substantially the same shape.

17. The electron emission type backlight unit as claimed in claim 1, wherein the first opening has a different shape than the second opening.

18. The electron emission type backlight unit as claimed in claim 1, wherein the electron emitting unit is formed to protrude and cover the boundary of the cathode that defined the first opening, and wherein the protrusion of the electron emitting unit does not exceed the boundary of the insulating unit that defines the second opening.

19. A flat panel display device, comprising:

the electron emission type backlight unit as claimed in claim 1; and a display panel that includes a light receiving element that controls light received from the electron emission type backlight unit.

20. The flat panel display device as claimed in claim 19, wherein the light receiving element is a liquid crystal.

21. The electron emission type backlight unit as claimed in claim 1, wherein the second opening is defined as a closed shape, the closed shape including a circle shape, an oval shape, a square shape or a star shape.

* * * * *